US006932932B2

(12) United States Patent
Miura et al.

(10) Patent No.: US 6,932,932 B2
(45) Date of Patent: Aug. 23, 2005

(54) METHOD OF FABRICATING HONEYCOMB BODY

(75) Inventors: Yasunao Miura, Nagoya (JP); Satoru Yamaguchi, Anjo (JP); Hiromi Katou, Kuwana (JP)

(73) Assignee: Denso Corporation, Kariya (JP)

( * ) Notice: Subject to any disclaimer, the term of this patent is extended or adjusted under 35 U.S.C. 154(b) by 209 days.

(21) Appl. No.: 10/045,085

(22) Filed: Jan. 15, 2002

(65) Prior Publication Data

US 2002/0093123 A1 Jul. 18, 2002

(30) Foreign Application Priority Data

Jan. 16, 2001 (JP) ..... 2001-007930
Dec. 4, 2001 (JP) ..... 2001-370393
Dec. 4, 2001 (JP) ..... 2001-370394

(51) Int. Cl.[7] ..... H05B 6/64; H05B 6/78
(52) U.S. Cl. ..... 264/414; 264/432
(58) Field of Search ..... 264/432, 414

(56) References Cited

U.S. PATENT DOCUMENTS 3,731,036 A * 5/1973 Hallier et al. ..... 219/695
4,837,943 A 6/1989 Mizutani
5,306,675 A * 4/1994 Wu et al. ..... 502/5
5,538,681 A * 7/1996 Wu ..... 264/432

FOREIGN PATENT DOCUMENTS

| | | |
|---|---|---|
| JP | A 63-166745 | 7/1988 |
| JP | A-63-166745 | 7/1988 |
| JP | B-2591843 | 12/1996 |
| JP | B-2637651 | 4/1997 |

* cited by examiner

*Primary Examiner*—Sean Vincent
(74) *Attorney, Agent, or Firm*—Oliff & Berridge, PLC

(57) ABSTRACT

Method of fabricating at least a honeycomb body include drying a plurality of honeycomb bodies, each having a multiplicity of cells arranged in the shape of a honeycomb and having a wall thickness of 0.125 mm or less, without cracking or wrinkling in the outer peripheral skin portion of the mold. Extrusion-molded argillaceous honeycomb bodies may be dried by placement on porous ceramics trays, having a dielectric loss of 0.1 or less, a porosity of 10% or more and a sectional open area ratio of 50% or more, exposure to at least 70% humidity and simultaneous irradiation with microwaves of 1,000 to 10,000 MHz. Alternatively, extrusion-molded argillaceous honeycomb bodies may be dried by exposure to at least 70% humidity and simultaneous irradiation with microwaves of 1,000 to 10,000 MHz, after which hot air is passed through the cells of the honeycomb bodies.

10 Claims, 10 Drawing Sheets

3
4
5
30
32
34
36
41
42
301
302
303
320
321
340
341

METHOD OF FABRICATING HONEYCOMB BODY

BACKGROUND OF THE INVENTION

1. Field of the Invention

The present invention relates to a method of fabricating at least a honeycomb body or, in particular, to a drying process and a drying system.

2. Description of the Related Art

In fabricating at least a honeycomb body of ceramic, at least an argillaceous honeycomb body is extrusion molded dried and baked. A method of drying at least a honeycomb body is known, as described in Japanese Unexamined Patent Publication No. 63-166745, and uses a high frequency current generated by applying a voltage between the electrodes arranged above and below a honeycomb body. This method is intended to heat the interior and the exterior of the honeycomb body uniformly thereby to prevent such defects as cracking and wrinkling which may be caused by a shrinkage difference attributable to the difference in the drying rate.

The drying method described above is effectively applicable to a honeycomb body having a cell wall thickness of 0.30 to 0.15 mm and an outer peripheral skin thickness of 0.3 to 1.0 mm generally used in the prior art as a catalyst carrier of an exhaust gas purification system of an automobile. In a thin-wall honeycomb body having a cell wall thickness of not more than 0.125 mm and an outer peripheral skin thickness of not more than 0.5 mm which has recently been developed to meet the need of an improved exhaust gas purification performance, however, the cell wall and the outer peripheral skin have a strength lower than those of the prior art. For this thin-wall honeycomb body, the conventional method of using a high frequency current cannot fully prevent defects in the outer peripheral portion.

SUMMARY OF THE INVENTION

The present invention has been developed in view of the problems of the prior art described above, and the object thereof is to provide a method of fabricating at least a honeycomb body and a drying system in which each honeycomb body having a cell wall thickness of not more than 0.125 mm can be dried without causing any defects such as the cracking or wrinkles of the outer peripheral skin.

According to a first aspect of the invention, there is provided a method of fabricating at least a honeycomb ceramic body comprising a multiplicity of cells arranged in the shape of a honeycomb and having a wall thickness of not more than 0.125 mm, in which at least an extrusion-molded argillaceous honeycomb body placed on a conveyance tray of porous ceramics having a dielectric loss of not more than 0.1, a porosity of not less than 10% and a sectional open area ratio of not less than 50% is dried by being exposed to a high humidity ambience of not less than 70% in humidity and irradiated with microwaves in the frequency range of 1,000 to 10,000 MHz.

In the fabrication method according to this invention, as described above, each honeycomb body is heated in a high-humidity ambience of not less than 70% in humidity. As a result, the outer peripheral surface of the honeycomb body can be prevented from drying so abruptly as to be deformed, and thus can be kept at the proper humidity. In this way, the difference in the drying rate between the outer peripheral surface and the interior of the honeycomb body can be reduced. Even in the case where the cell wall thickness is as small as not more than 0.125 mm and the thickness of the outer peripheral skin portion is comparatively small, therefore, the difference in shrinkage due to the drying rate difference between the exterior and the interior of the honeycomb body can be reduced. Cracking, wrinkling, or the like defects can thus be prevented from developing in the outer peripheral skin portion. The humidity of the high-humidity ambience is preferably as high as possible. Thus, the humidity of 80% or more or even the supersaturated state is allowable.

Also, in this aspect of the invention, microwaves, as described above, are used as heating means. In this way, heating in the high-humidity ambience described above can be realized. Specifically, the conventional heating with high frequency current requires electrodes to be arranged in proximity to the honeycomb bodies. The arrangement of the electrodes in the high-humidity ambience would probably cause a discharge or an dielectric breakdown between the electrodes thereby leading to an equipment malfunction.

Microwaves, in contrast, can be introduced through at least a waveguide and no electrode is required to be arranged in the vicinity of the object to be heated. Microwaves can easily reach and heat each honeycomb body even in a high-humidity ambience.

As described above, in this aspect of the invention, even in the case where the cell wall thickness is as small as 0.125 mm and the outer peripheral skin portion is comparatively thin, the combination of the microwave heating means and the high-humidity ambience can sufficiently prevent the outer peripheral skin portion from cracking or wrinkling at the time of drying. The improved quality of the drying process can achieve a high quality of the honeycomb body, as a baked product, obtained in the subsequent baking process.

Further, according to this invention, the drying process is carried out with each honeycomb body placed on a conveyance tray made of a porous ceramic having a dielectric loss of not more than 0.1, a porosity of not less than 10% and a sectional open area ratio of not less than 50%. The honeycomb body can be supported during the drying process not only by a method using the conveyance tray of a specific ceramic as described above, but, of course, also by use of a tray made of an ordinary ceramic. Nevertheless, the use of the tray of a specific ceramic can suppress the inconveniences which otherwise might be caused on the contact surface between the honeycomb body and the support member at the time of drying the honeycomb body.

Specifically, the components of the argillaceous honeycomb body may elute, it in contact with a water film. In the case where water from the high-humidity ambience or water evaporated from the honeycomb body stays in the portion in contact with a member supporting the honeycomb body, therefore, the components of the honeycomb body may elute at the particular contact portion, In the case where the honeycomb body is placed on a conveyance tray of porous ceramic having a porosity of not less than 10% and a sectional open area ratio of not less than 50%, however, the water is prevented from staying in the neighborhood of the contact portion between the conveyance tray and the honeycomb body by the drainage action through the pores of the conveyance tray. In the case where the porosity is less than 10% or the sectional open area ratio is less than 50%, however, the drainage action may not be sufficiently achieved.

Also, in the case where the other members supporting the honeycomb body have a large dielectric loss, such other members are also heated by the microwaves for heating the honeycomb body. In such a case, the honeycomb body at the contact portion is locally heated rapidly by direct heat transmission from the heated other members and may be deformed. By placing the honeycomb body on the conveyance tray having the dielectric loss of not more than 0.1 as described above, in contrast, the heating of the conveyance tray can be avoided thereby preventing the inconvenience described above.

According to a second aspect of the invention, there is provided a method of fabricating at least a honeycomb body, wherein the honeycomb body is desirably placed with one of the open ends of each cell placed in contact with the upper surface of the conveyance tray. Nevertheless, the honeycomb body can be placed on the conveyance tray in an arbitrary direction. In the case where the one of the open ends of the cells is brought into contact with the upper surface of the conveyance tray, however, the communication can be secured between the pores of the conveyance tray and the cells of the honeycomb body.

According to a third aspect of the invention, there is provided a method of fabricating at least a honeycomb body, wherein the conveyance tray is preferably made of foamed urea resin. In this case, it is easy to acquire a conveyance tray having the dielectric loss characteristic, the porosity and the sectional open area ratio in the proper range described above.

According to a fourth aspect of the invention, there is provided a method of fabricating at least a honeycomb body, wherein the honeycomb body is preferably dried by arranging adjacent bodies at predetermined spatial intervals. In such a case, microwaves can be evenly radiated on each honeycomb body and the drying irregularities can be suppressed. It is thus possible to prevent more fully the troubles which may otherwise occur during the drying process.

According to a fifth aspect of the invention, there is provided a method of fabricating at least a honeycomb body, wherein the honeycomb body is preferably dried while changing the conditions for microwave radiation in accordance with the quantity of the honeycomb bodies. In such a case, the microwaves can be uniformly radiated on each of the honeycomb bodies regardless of how many of them exist in the drying bath. Thus, the troubles which otherwise might be caused at the time of drying can be fully prevented.

According to a sixth aspect of the invention, there is provided a system for drying at least an extrusion-molded argillaceous honeycomb body to fabricate at least a honeycomb body of ceramic composed of a multiplicity of cells arranged in the shape of a honeycomb with the cell wall not thicker than 0.125 mm, the drying system comprising a drying bath for accommodating the honeycomb body, a humidifier for creating a high-humidity ambience of not lower than 70% in humidity in the drying bath, a plurality of microwave generators for supplying microwaves in the frequency range of 1,000 to 10,000 MHz into the drying bath, and a conveyor system for continuously supplying and delivering a plurality of honeycomb bodies into and out of the drying bath.

By using the drying system described above, the drying process of the fabrication method can be easily realized to produce a high-quality honeycomb body. Specifically, the honeycomb bodies to be dried are placed in the drying bath, and the internal humidity of the drying bath is increased to at least 70% by the humidifier thereby to create the high-humidity ambience. The honeycomb bodies can be heated in the high-humidity ambience by introducing microwaves from the microwave generators described above. As a result, each honeycomb body can be dried without generating any cracking or wrinkles in the outer peripheral skin portion thereof, Further, the drying system according to this aspect of the invention comprises the conveyor system for supplying and delivering a plurality of the honeycomb bodies into and out of the drying bath continuously. With this drying system, therefore, the honeycomb bodies can be dried very efficiently while at the same time preventing the outer peripheral portion of the Molds from developing cracking or wrinkling.

According to a seventh aspect of the invention, there is provided a drying system, wherein the drying bath preferably includes the openings for supplying and delivering a plurality of the honeycomb bodies into and out of the drying bath, and shield means for preventing the high-humidity air in the drying bath from mixing with the atmospheric air in the particular openings. In such a case, a uniform and high-humidity ambience can be formed in the drying bath. Also, since the high-humidity air in the drying bath can be prevented from flowing out of the drying bath, the desired high-humidity ambience can be formed with a compact humidifier, etc.

According to an eighth aspect of the invention, there is provided a drying system, wherein the shield means is preferably so configured as to shield the high-humidity ambience in the drying bath from the external atmosphere by forming an air flow for shielding the openings. In such a case, the functions and effects Lark described above can be obtained with a compact and simplified equipment configuration.

According to a ninth aspect of the invention, there is provided a drying system preferably so configured as to change the conditions for microwave radiation in accordance with the quantity of the honeycomb bodies existing in the drying bath. Then, even in the case where the quantity of the honeycomb bodies in the drying bath is changed, the amount of microwave radiated on each honeycomb body can be equalized.

According to a tenth aspect of the invention, there is provided a drying system preferably comprising an accumulator function for adjusting the supply of the honeycomb bodies in such a manner that the honeycomb bodies supplied into the drying bath are arranged at equal spatial intervals.

The accumulator function is defined as a function to adjust the variations of the quantity of the honeycomb bodies supplied to the conveyor system and to supply the honeycomb bodies into the drying bath at predetermined spatial intervals. The accumulator function makes it possible to convey the honeycomb bodies with the honeycomb bodies arranged at equal intervals in the drying bath regardless of the manner in which the honeycomb bodies are supplied to the conveyor system.

According to an 11th aspect of the invention, there is provided a drying system preferably comprising a plurality of microwave introduction ports. By radiating microwaves from a plurality of the introduction ports, the variations of the microwave density in the drying bath can be suppressed. AS a result, the drying irregularities can be suppressed, thereby further improving the functions and effects of the invention.

According to a 12th aspect of the invention, there is provided a drying system comprising a first introduction port in the neighborhood of the opening for supplying the honeycomb bodies into the drying bath and a second introduction port in the neighborhood of the opening for delivering the honeycomb bodies out of the drying bath, wherein the first introduction port is preferably so configured as to radiate microwaves toward the opening for delivering the bodies and the second introduction port is preferably so configured as to radiate microwaves toward the opening for supplying the bodies. By radiating microwaves toward each other along the direction of conveyance, the variations of the microwave density can be further suppressed between the supply and delivery sides of the drying bath.

According to a 13th aspect of the invention, there is provided a drying system comprising a first introduction port formed in the upper side of the opening for supplying the honeycomb bodies into the drying bath and a second introduction port formed in the lower side of the same opening, wherein the first introduction port and the second introduction port are preferably so configured as to radiate microwaves toward the opening for delivering the honeycomb bodies out of the drying bath. By arranging the microwave introduction ports as described above, the variations of the microwave density can be further suppressed in the vertical direction of the drying bath.

According to a 14th aspect of the invention, there is provided a drying system comprising a first introduction port formed in the upper portion of the drying bath and a second introduction port formed in the lower portion of the drying bath, wherein the first introduction port is preferably so configured as to radiate microwaves toward the lower portion of the drying bath and the second introduction port is preferably so configured as to radiate microwaves toward the upper portion of the drying bath. By radiating the microwaves toward each other in the vertical direction, the variations of the microwave density between the upper and lower sides of the drying bath can be further suppressed.

According to a 15th aspect of the invention, there is provided a drying system comprising a first introduction port and a second introduction port arranged on the two inner sides of the drying bath in opposed relation to each other with the conveyor system therebetween, wherein the first introduction port is preferably configured to radiate microwaves toward the side of the drying system having the second introduction port, and the second introduction port is preferably configured to radiate microwaves toward the other side having the first introduction port. By radiating the microwaves toward each other along the direction perpendicular to the direction of conveyance and parallel to the ground in this way, the variations of the microwave density between the two sides of the drying bath with the conveyor system therebetween can be further suppressed.

According to a 16th aspect of the invention, there is provided a method of fabricating at least a honeycomb ceramic body comprising a multiplicity of cells arranged in the shape of a honeycomb and having the wall thereof not more than 0.125 mm thick, in which at least an extrusion-molded argillaceous honeycomb body is dried by being exposed to a high humidity ambience of not less than 70% in humidity and irradiated with microwaves in the frequency range of 1,000 to 10,000 MHz, after which hot air is applied to the honeycomb body in such a manner as to pass through the cells thereof.

In the fabrication method according to this invention, as described above, each honeycomb body is heated in a high-humidity ambience of not less than 70% in humidity. As a result, the outer peripheral surface of the honeycomb body can be prevented from drying so abruptly as to be deformed, and thus can be kept at the proper humidity. In this way, the difference in the drying rate between the outer peripheral surface and the interior of the honeycomb body can be reduced. Even in the case where the cell wall thickness is as small as not more than 0.125 mm and the thickness of the outer peripheral skin is comparatively small, therefore, the difference in shrinkage due to the drying rate difference between the exterior and the interior of the honeycomb body can be reduced. The cracking, wrinkling, or the like defects can thus be prevented from developing in the outer peripheral skin portion. The humidity of the high-humidity ambience is preferably as high as possible at 80% or more, or even the supersaturated state is allowable.

Also in this invention, microwaves, as described above are used as the heating means. As a result, heating in the high-humidity ambience can be realized. Specifically, in the conventional heating means using a high frequency current, the electrodes are required to be arranged in the vicinity of the honeycomb bodies, and if these electrodes are arranged in the high-humidity ambience, the discharge or the dielectric breakdown could be caused between the electrodes, thereby probably leading to the equipment malfunction due to the breakage of the electrodes.

In contrast, according to this embodiment, microwaves can be introduced through a waveguide, and no electrode is required in the vicinity of the object to be heated. For this reason, the microwaves can easily reach and heat the honeycomb body even in the high-humidity ambience.

As described, according to this invention, the combination of the microwave heating means and the high-humidity ambience makes it possible to sufficiently prevent the generation of cracking or wrinkling in the outer peripheral skin portion at the time of drying even in the case where the cell wall is as thin as 0.125 mm and the outer peripheral skin portion is also comparatively thin. With the improved drying quality, the honeycomb body, as a baked product, obtained in the subsequent baking process comes to have a superior quality.

Further, according to this invention, after the drying process with microwaves in the high-humidity ambience described above, hot air is applied to the honeycomb body in such a manner as to pass through the cells thereof.

In such a case, the microwave heating operation in the high-humidity ambience can be easily controlled, and thus it becomes possible to prevent the excessive heating of the honeycomb body by microwaves. Hot air at such a temperature as not to cause excessive heating can realize accurate, complete drying.

The complete drying is defined as the situation in which the water content of the honeycomb body is reduced to 5% or less of the initial figure.

According to a 17th aspect of the invention, there is provided a method of fabricating at least a honeycomb ceramic body, wherein the temperature of the hot air is preferably 50 to 140° C. Nevertheless, the temperature of the hot air is not limited to these figures to achieve the functions and effects described above, but may assume an arbitrary value. In the case where the hot air temperature is lower than 50° C., however, the temperature of the honeycomb body is liable to be reduced excessively for a reduced drying efficiency. In the case where the temperature of the hot air exceeds 140° C., on the other hand, the abrupt progress of drying may cause trouble in the honeycomb body involved.

According to an 18th aspect of the invention, there is provided a method of fabricating at least a honeycomb ceramic body, wherein the honeycomb body is dried by the hot air preferably after the water content of the honeycomb body is reduced to 5 to 30% by weight by irradiation with microwaves.

Nevertheless, the water content of the honeycomb body after irradiation with microwaves is not limited to achieve the functions and effects described above, but predetermined functions and effects can be achieved by the microwave heating means and the hot air drying means combined.

In the case where the water content of the honeycomb body after microwave irradiation is less than 5%, the microwave heating operation becomes more difficult to control, and a part of the honeycomb body may be excessively heated by irregularities in the microwave radiation. In the case where the water content of the honeycomb body exceeds 30%, on the other hand, the subsequent application of hot air may not achieve the completely dry state.

More preferably, the honeycomb body is dried by microwave heating in the high-humidity ambience to the water content of not less than 10 to 20% , followed by complete drying with hot air.

According to a 19th aspect of the invention, there is provided a method of fabricating at least a honeycomb ceramic body, wherein the honeycomb body is dried by applying cool air, after hot air, thereto. Taking into consideration the handling ease after drying the honeycomb body as described above, the honeycomb body should be cooled to room temperature. In the process, the honeycomb body can be more efficiently cooled by being exposed to cool air.

This aspect of the invention is effectively applicable to the work of cutting off the end surfaces of the honeycomb body after being dried with hot air. Otherwise, the problem is posed that the cutting dust may be attached to the honeycomb body high at a temperature.

According to a 20th aspect of the invention, there is provided a method of fabricating at least a honeycomb ceramic body, wherein the temperature of the cool air is preferably 0 to 30° C. Nevertheless, the temperature of the cool air is not limited such a figure to achieve the functions and effects described above. In the case where the temperature of the cool air is lower than 0° C., however, the honeycomb body would be cooled so rapidly that a trouble may occur in the outer peripheral portion, etc. In the case where the temperature of the cool air is higher than 30° C., on the other hand, efficient cooling of the honeycomb body is impossible.

According to a 21st aspect of the invention, there is provided a system for drying at least an extrusion-molded argillaceous honeycomb body to fabricate a honeycomb body of ceramic composed of a multiplicity of cells arranged in the shape of a honeycomb with the cell wall not thicker than 0.125 mm, the drying system comprising a drying bath for accommodating at least a honeycomb body, a humidifier for creating a high-humidity ambience of not lower than 70% in humidity in the drying bath$ a plurality of microwave generators for supplying microwaves in the frequency range of 1,000 to 10,000 MHz into the drying bath, and a hot air generator for generating hot air to be applied to the honeycomb body inside or outside the drying bath.

By using the drying system described above, the drying process of the fabrication method can be easily realized to produce a high-quality honeycomb body, Specifically, at least one honeycomb body to be dried is placed in the drying bath, and the internal humidity of the drying bath is increased to at least 70% by the humidifier thereby to create the high-humidity ambience. The honeycomb body can be heated in the high-humidity ambience by introducing the microwave from the microwave generators described above. As a result, each honeycomb body can be dried without developing any cracking or wrinkles in the outer peripheral skin portion thereof.

Further, by applying the hot air sent out from the hot air generator in or outside the drying bath to the honeycomb body, the honeycomb body can be dried easily by the combination of the microwave heating means in the high-humidity ambience and the hot air heating means. As described above, in this case, the microwave heating operation in the high-humidity ambience can be controlled easily, thereby making it possible to prevent the trouble which otherwise might occur due to the overheating with microwave. The complete drying can be realized with high accuracy by the hot air of a temperature not liable to cause overheating.

The drying system may be of either a continuous type or a batch type. In the drying system of a continuous type, a plurality of honeycomb bodies are sequentially supplied to and delivered from the drying bath continuously.

According to a 22nd aspect of the invention, there is provided a system for drying at least a honeycomb ceramic body, wherein the hot air generator preferably has a hot air source for generating a hot air having a temperature of 50 to 140° C. The hot air in this temperature range can dry the honeycomb bodies efficiently while avoiding the trouble at the peripheral skin portion, etc.

According to a 23rd aspect of the invention, there it provided a system for drying at least a honeycomb ceramic body, preferably comprising a cool air generator arranged inside or outside the drying bath for generating cool air to be applied to the honeycomb body. In such a case, the honeycomb body can be rapidly cooled after being dried with hot air. As a result, the process after the drying step can be executed quickly. Especially in the case where the honeycomb body is cooled as described above, the cutting dust can be fully prevented from attaching during the work of cutting off the end surfaces of the honeycomb body.

According to a 24th aspect of the invention, there is provided a system for drying at least a honeycomb ceramic body, wherein the cool air generator preferably includes a cool air source for generating a cool air in the temperature range of 0 to 30° C. The cool air in this temperature range, as described above, can cool the honeycomb body efficiently while avoiding the trouble of the outer peripheral skin portion, etc.

DESCRIPTION OF THE PREFERRED EMBODIMENTS

First Embodiment

A method of fabricating at least a honeycomb body and a drying system according to an embodiment of the invention will be explained with reference to FIGS. 1, 2(*a*) and 2(*b*).

Figure 2A:
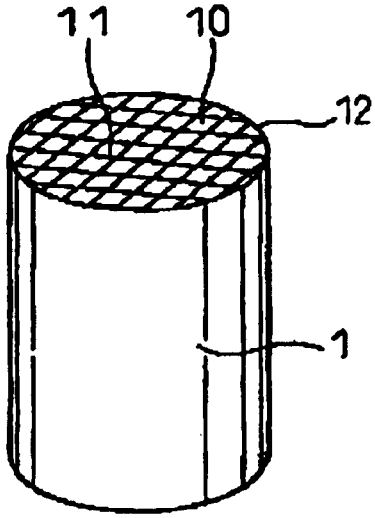
FIG. 2(*a*) is a perspective view of a honeycomb body, and FIG. 2(*b*) is a diagram for explaining the cell wall thickness, according to the first embodiment of the invention.
Figure 2B:
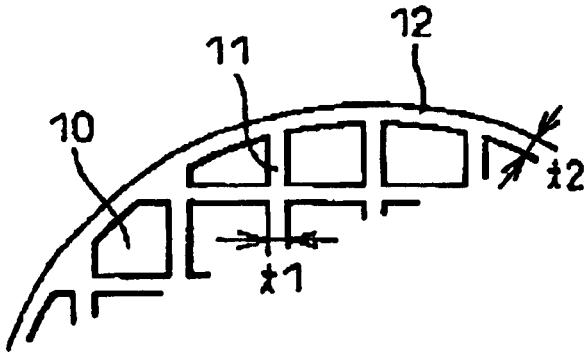

This embodiment, as shown in FIGS. 2(*a*) and 2(*b*), represents a method of fabricating a honeycomb body 1 of ceramics including a multiplicity of cells 10 arranged in the shape of a honeycomb with a plurality of cell walls 11 having a thickness t1 not more than 0.125 mm. The honeycomb body according to this embodiment, as shown in FIGS. 2(*a*), and 2(*b*), includes a plurality of square cells 10 and a cylindrical outer peripheral skin portion 12 having a thickness t2 not more than 0.5 mm. The aforementioned shapes of the cells and the whole honeycomb body can be changed in accordance with a specific application.

In the method according to this embodiment, the argillaceous honeycomb body 1 produced by extrusion molding is dried by being exposed to a high-humidity ambience of not less than 70% in humidity while at the same time being irradiated with microwaves in the frequency range of 1,000 to 10,000 MHz. After that, hot air can be applied to the honeycomb body 1 in such a manner as to pass through the cells thereof.

A detailed explanation of this embodiment will be made below.

In fabricating the honeycomb body 1 according to this embodiment, the first step is to add an organic binder at 5 parts by weight and water at 15 parts by weight to a ceramic power material, mainly of cordierite, at 100 parts by weight, and knead the mixture to thereby make an argillaceous ceramic material.

The next step is to extrude the ceramic material from a honeycombed die using an extrusion molding machine (not shown), and to sequentially cut the extruded honeycomb body stock into a plurality of molds of a predetermined length thereby to produce a plurality of argillaceous honeycomb bodies 1. The extrusion molding machine used is of plunger type, auger type, etc.

According to this embodiment, the slit width of each cell wall portion of the honeycombed die is set to 0.115 mm and the slit width of the outer peripheral skin portion thereof to 0.3 mm.

Figure 1:
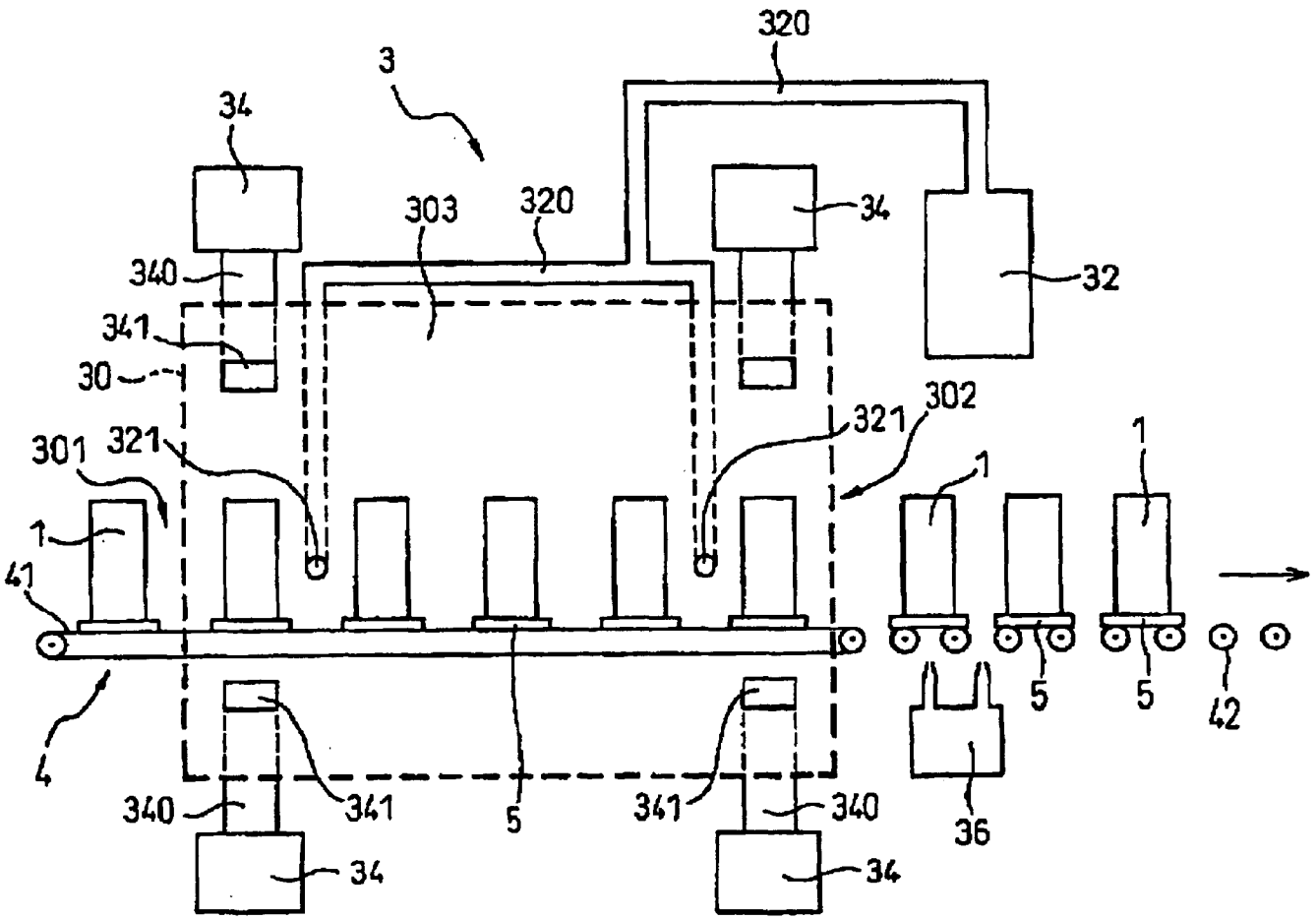
FIG. 1 is a diagram for explaining a configuration of the drying system according to a first embodiment of the invention.

The thin-wall honeycomb bodies 1 obtained by extrusion molding as described above are dried using a drying system 3 shown in FIG. 1.

The drying system 3, as shown in FIG. 1, comprises a drying bath 30 for accommodating the honeycomb bodies 1, a humidifier 32 for creating a high-humidity ambience of not lower than 70% in humidity in the drying bath 30, and a plurality of microwave generators 34 for supplying microwaves in the frequency range of 1,000 to 10,000 MHz into the drying bath 30.

The drying bath 30 has such a size as to accommodate a plurality of the honeycomb bodies 1 transported by a conveyor system 4 described later.

Waveguides 340 extended from the four microwave generators 34, respectively, are connected to and open at the four corner portions of the side wall 303 of the drying bath 30. These openings constitute microwave introduction ports 341.

Also, two steam pipes 320 extending and branching from a boiler constituting the humidifier 32 are connected to and opened to two longitudinal points of the side wall 303. These openings make up steam introduction ports 321. The steam introduced by way of the steam introduction ports 321 is a high-temperature steam sent from the boiler as described above and not lower than 80° C. in temperature.

The drying system 3 according to this embodiment also comprises the conveyor system 4 for conveying the honeycomb bodies. This conveyor system 4 is configured as a continuous system capable of supplying and delivering a plurality of the honeycomb bodies 1 continuously to and from the drying bath 30.

Specifically, a belt conveyor 41 connecting the inlet portion 301 and the outlet portion 302 of the drying bath 30 is arranged in the drying bath 30. Also, a roller conveyor 42 is arranged outside the outlet portion of the drying bath 30.

The conveyor system 4 including the belt conveyor 41 and the roller conveyor 42 is configured to convey conveyance trays 5 each with the honeycomb body 1 placed thereon. According to this embodiment, the conveyance tray 5 is made of porous ceramics, or cordierite in the present case, having a dielectric loss of not more than 0.1, a porosity of not less than 10% and a sectional open area ratio of not less than 50%. This material can be replaced with urea resin, etc. On each conveyance tray 5, the honeycomb body 1 is placed with one of the open end surfaces (101) of the cells 10 thereof kept in contact with the upper surface 51 of the conveyance tray 5. AS a result, the cells 10 of the honeycomb body 1 are oriented in vertical direction and at the same time communicate with the pores of the conveyance tray 5.

A hot air generator 36 is arranged under the roller conveyor 42 outside the drying bath 30. This hot air generator 36 is configured to blow the hot air at 120° C. upward from under the conveyance trays 5 moving on the roller conveyor 42. This temperature is not so high as to burn the binder contained in the honeycomb bodies 1.

In drying each extrusion-molded honeycomb body 1 using the drying system 3 configured as described above, the first step is to place each of the honeycomb bodies 1 of a predetermined length on the conveyance tray 5 and further to sequentially place the resulting pairs of the mold 1 and the tray 5 on the belt conveyor 41, as shown in FIG. 1. The honeycomb bodies 1 are thus sequentially transported into the drying bath 30.

Each honeycomb body 1 sent into the drying bath 30 is dried while moving toward the outlet 302 from the inlet 301 with the movement of the belt conveyor 41.

The interior of the drying bath 30 provides a high-humidity ambience maintained at a humidity of not less than 70% (not less than 80% in this embodiment) and the temperature of not lower than 80° C. by the high-temperature steam introduced from the humidifier 32. At the same time, microwaves generated by the microwave generators 34 are introduced into the drying bath 30. AS a result, the honeycomb bodies 1 in the drying bath 30 are rapidly dried while being prevented from developing cracking or wrinkling in the outer peripheral skin portion 12 thereof.

Specifically, as the drying bath 30 is maintained in a high-temperature high-humidity ambience as described above, the honeycomb body 1 being heated is not dried so abruptly as to deform the outer peripheral surface thereof but is maintained at an appropriate humidity. Thus, the difference in drying rate between the outer peripheral surface and the interior of the honeycomb body 1 can be reduced. Even with the honeycomb body 1 having the cell wall as thin as not more than 0.125 mm as in this embodiment, therefore, the difference in shrinkage between the interior and the exterior of the honeycomb body 1 due to the difference in drying rate can be reduced. As a result, the outer peripheral skin portion 12 can be prevented from developing such a defect as a cracking or a wrinkle.

Also, in this embodiment, microwaves are used as the heating means. Microwaves can be easily introduced through waveguides 70 even in the case where the interior of the drying bath 30 forms a high-humidity ambience as described above. Thus, the honeycomb body 1 can be easily heated dielectrically without any complicated equipment configuration.

As described above, according to this embodiment, even in the case where the cell wall thickness is not more than 0.125 mm and the thickness of the outer peripheral skin portion is not more than 0.3 mm, the development of cracking or wrinkling of the outer peripheral skin portion at the time of drying can be sufficiently prevented by the microwave heating and the high-humidity ambience combined.

Further, in this embodiment, after the drying process by the high-humidity ambience in the drying bath 30, the hot air generated from the hot air generator 36 is applied to the honeycomb body 1 in such a manner as to pass through the cells 10 thereof. Specifically, according to this embodiment, the honeycomb body 1 is dried by the combination of the microwave heating process and the hot air in the high-humidity ambience. More specifically, the honeycomb body 1 is dried first by microwave heating means in the high-humidity ambience to such an extent that the water content of the honeycomb body remains at 10 to 20% of the figure before drying, and after that, the honeycomb body 1 is dried completely by hot air to attain a water content of not more than 5%

As a result, heating by microwaves in the high-humidity ambience can be easily controlled, thereby preventing such inconvenience as burning off the binder component of the honeycomb body by excessive heating with microwaves. In this way, the complete drying can be realized with high accuracy by hot air not so high in temperature as to cause excessive heating.

The drying system 3 according to this embodiment comprises the conveyor system 4 as described above and has a configuration capable of continuous operation. For this reason, the drying process can be performed very efficiently.

Further, the conveyance trays 5 according to this embodiment employ a specific porous ceramic called cordierite having a dielectric loss of not more than 0.1, a porosity of not less than 10% and a sectional open area ratio of not less than 50%. As a result, during the drying by microwaves, water can be prevented from stagnating and the conveyance trays 5 can be prevented from increasing in temperature. Further, during the heating with hot air, the hot air can be easily supplied through the pores and passed into the cells 10.

Second Embodiment

According to this embodiment, a test is conducted to determine the correlation between the humidity and the quality of the outer peripheral skin portion by changing the humidity by the amount of the high-temperature steam introduced to the drying bath 30 using the drying system 3 according to the first embodiment. Except for humidity, the same conditions are employed as those for the first embodiment.

Figure 3:
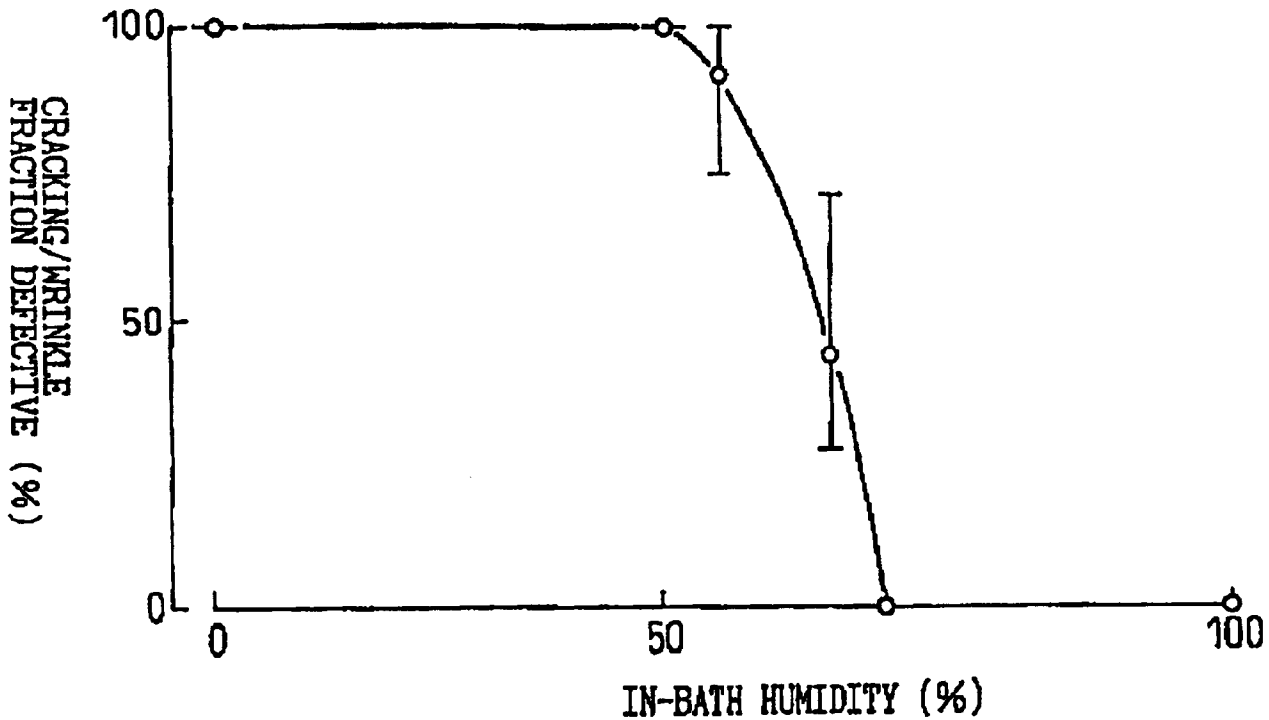
FIG. 3 is a diagram for explaining the relation between the internal humidity of the drying bath and the cracking/wrinkling defective fraction according to a second embodiment of the invention.

The test result is shown in FIG. 3. In FIG. 3, the abscissa represents the internal temperature of the drying bath 30, and the ordinate the cracking/wrinkling defective fraction of the outer peripheral skin portion. In each session of the test, 20 honeycomb bodies were processed, and by determining the percentage of those honeycomb bodies which have developed even a small cracking or wrinkling as defective products, the ratio of the number of defective products is calculated as a defective fraction.

As seen from FIG. 3, it has been found that the effect of cracking/wrinkling prevention begins to be exhibited by increasing the humidity to higher than 50%, and the cracking and wrinkling can be almost completely prevented at a humidity of not less than 70%.

Third Embodiment

According to this embodiment, a test is conducted to check for any malfunction due to water stagnation during the drying process by changing both the porosity of the conveyance tray 5 and the internal humidity of the drying bath 30 in the first embodiment. The conditions other than the porosity of the conveyance tray 5 and the humidity in the drying bath 30 are similar to the corresponding figures in the first embodiment.

Figure 4:
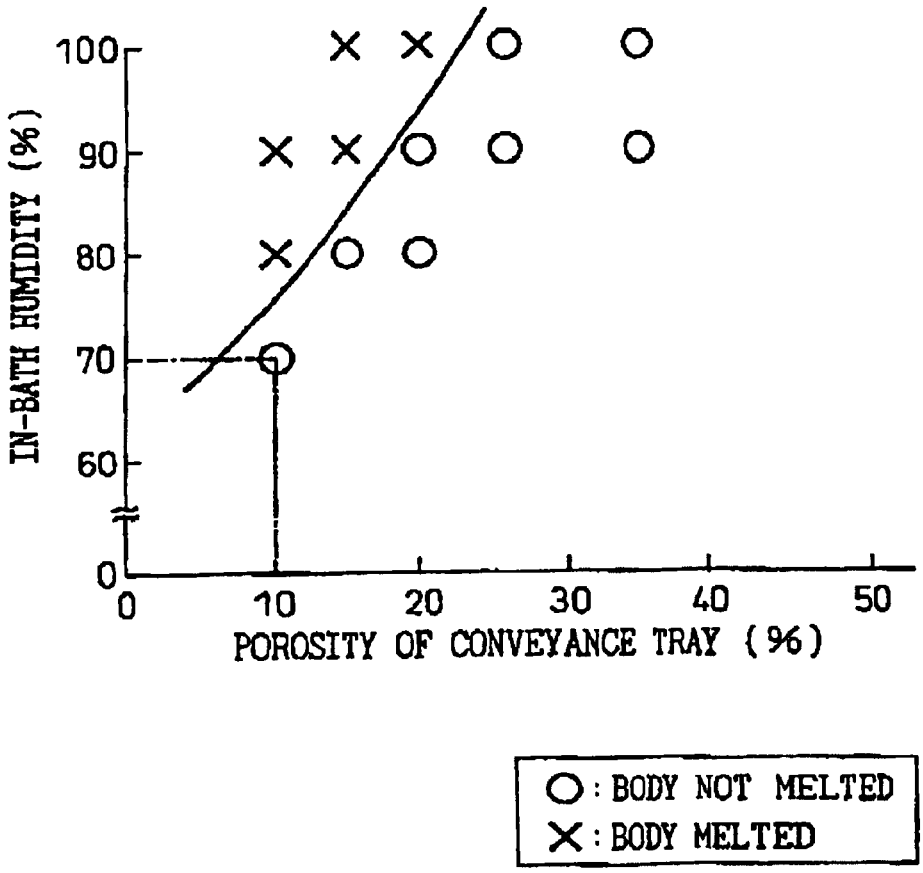
FIG. 4 is a diagram for explaining the relation between the porosity of the conveyance tray, the internal humidity of the drying bath and the elution of the honeycomb body.

The test result is shown in FIG. 4. In FIG. 4, the abscissa represents the porosity of the conveyance tray, and the ordinate the humidity of the drying bath. One session of the drying process is conducted under each condition, and the graph is plotted by indicating with X a case in which even a small elution occurs from the cell wall or the outer peripheral skin portion, and with ○ a case in which no such elution occurs.

As seen from FIG. 4, the higher the humidity, the easier the elution occurs. In the case where the humidity is at least 70%, the elution can be prevented by setting the porosity of the conveyance tray to not less than 10%. It is also seen that even at a humidity of 100%, the elution can be prevented by setting the porosity of the conveyance tray to not less than 25%, Fourth Embodiment This embodiment, like the first embodiment, represents a case in which the honeycomb bodies are supplied into the drying bath, using a conveyor system having an accumulator function, for drying the honeycomb bodies.

Figure 5:
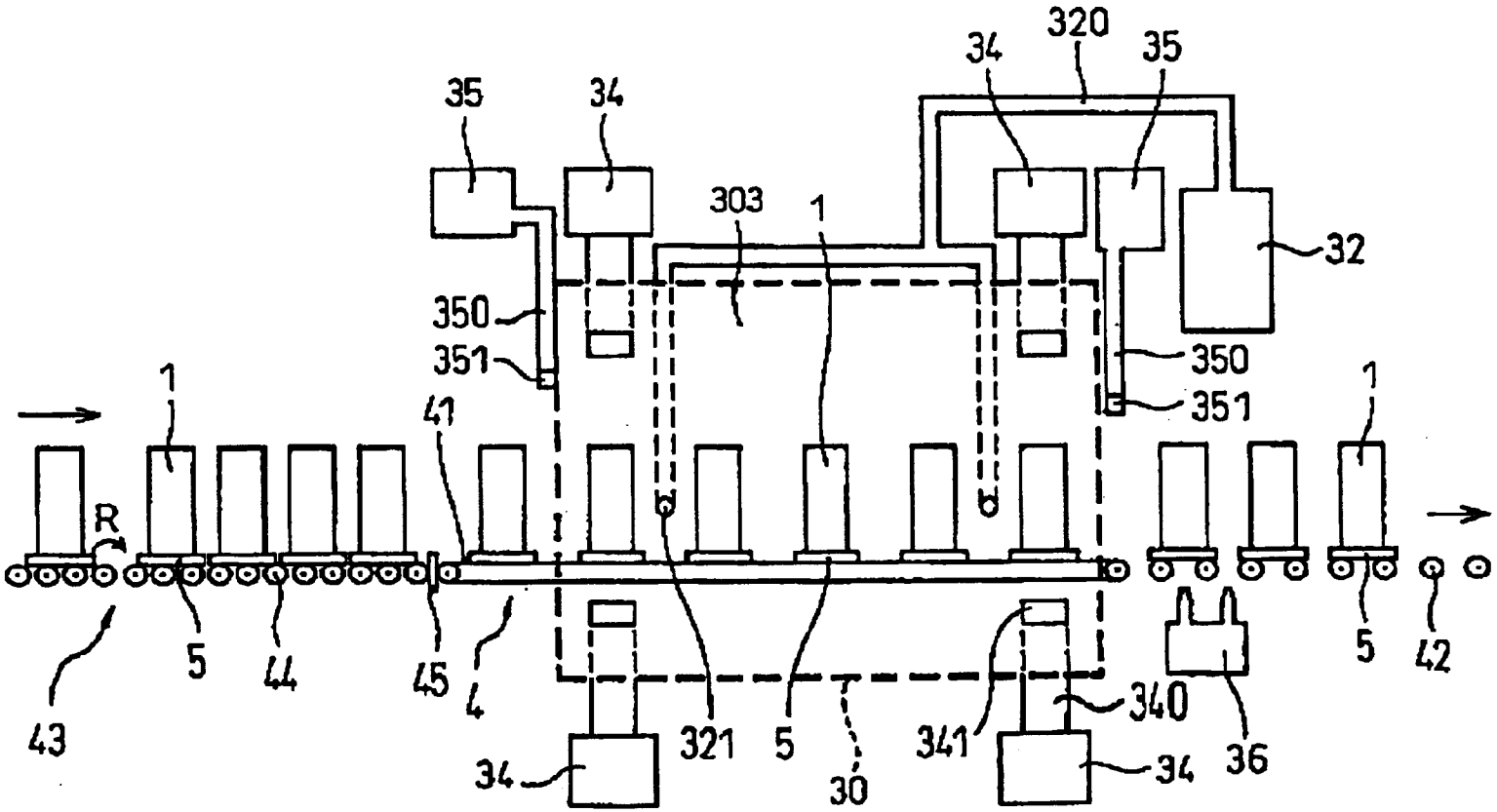
FIG. 5 is a diagram for explaining a configuration of the drying system according to a fourth embodiment of the invention.

As shown in FIG. 5, this embodiment is implemented using the drying system 3. The drying system 3 based on the counterpart 3 of the first embodiment additionally includes an accumulating conveyor 43 functioning as the accumulator and a stopper 45 for holding the honeycomb bodies 1 on the accumulating conveyor 43. Further, the drying system based on the counterpart 30 of the first embodiment, additionally includes air generators 35 forming an air curtain in each opening of the drying bath 30.

The air curtain is defined as a planar air flow formed in parallel to each opening of the drying bath communicating with outside to prevent the ambiences inside and outside the drying bath from mixing with each other.

The accumulating conveyor 43 includes a plurality of cylindrical rollers 44. Each cylindrical roller 44 is mounted with the axis thereof in parallel to the ground surface and perpendicular to the direction of conveyance. The accumulating conveyor 43 includes a plurality of the cylindrical rollers 44 aligned in the direction of conveyance. Further, the cylindrical rollers 44 are coupled to a motor, not shown, and, as shown in FIG. 5, are adapted to rotate in the direction of arrow R.

The accumulating conveyor 43 conveys the honeycomb bodies 1 by the friction force generated between the outer peripheral surface of the cylindrical rollers 44 in rotation and the conveyance trays 5. The outer peripheral surface of each cylindrical roller 44 is formed with a smooth surface, so that the honeycomb bodies 1 can easily stay on the accumulating conveyor 43.

According to this embodiment, the stopper 45 switches the conveyance mode and the staying mode of the honeycomb bodies 1. As shown in FIG. 5, the stopper 45 is protruded upward into contact with the side surface of the conveyance tray 5 in the neighborhood of the inlet 301 of the drying bath 30.

Each air generator 35 includes an air pipe 350 and an air jet port 351. The air jet port 351 is arranged in the neighborhood of each of the openings of the inlet 301 and the outlet 302 of the drying bath 30. Further, the air jet port 351 blows air in the diagonal direction of the opening thereby to form an air flow parallel to the opening plane.

According to this embodiment, the honeycomb body 1 is dried using the drying system 3 having the configuration described above.

The honeycomb bodies 1 sent into the drying system are placed on the conveyance trays 5 and transported by the accumulating conveyor 43. When the honeycomb body 1 is transported to the neighborhood of the inlet 301 of the drying bath 30, the associated conveyance tray 5 comes into contact with the stopper 23 and stops. After that, a plurality of the honeycomb bodies 1 are sent successively into the drying system 3, and sequentially stop on the accumulating conveyor 43. The honeycomb bodies 1 thus stopped form a line on the accumulating conveyor 24.

A predetermined number of the honeycomb bodies 1, after staying on the accumulating conveyor 43, begin to be sent into the drying bath 30.

First, one of the honeycomb bodies 1 is delivered out by operating the stopper 23. Then, the stopper is restored to the original position, and the remaining honeycomb bodies 1 are stopped again. Upon the lapse of a predetermined time interval, one of the honeycomb bodies 1 is delivered out again as described above. This series of process is repeatedly carried out. The "predetermined time interval" is determined in accordance with the interval at which the honeycomb bodies 1 are to be arranged on the accumulating conveyor 24.

As described above, according to this embodiment, the honeycomb bodies 1 can be sent into the drying bath 30 at predetermined intervals different from the timing at which they are supplied to the drying system 3. As a result, the honeycomb bodies 1 can be always arranged equidistantly in the drying bath 30.

Also in this embodiment, an air curtain is formed in each opening of the drying bath 30. As a result, the supply and delivery of the honeycomb bodies to and from the drying bath 30 are facilitated, while at the same time preventing the high-humidity ambience in the drying bath 30 mixing with the external atmosphere. A uniform high-humidity ambience can thus be maintained accurately in the drying bath 30.

According to this embodiment, as described above, microwaves can be radiated uniformly on the honeycomb bodies 1 in a uniform high-humidity ambience held in the drying bath 30. With the honeycomb bodies 1 dried in the drying system 3, therefore, the generation of drying irregularities can be suppressed further.

Thus, the cracking or wrinkling of the outer peripheral skin portion 12 can be more sufficiently prevented at the time of drying the honeycomb bodies 1 having thin cell walls.

The other parts of the configuration and the functions and effects are similar to those of the first embodiment.

Fifth Embodiment

This embodiment represents a case in which the microwave output value of the drying system 3 is adjusted in accordance with the quantity of the honeycomb bodies 1 existing in the drying bath 3 in the first embodiment.

The proper value of microwave output of the drying system 3 was studied in advance. As a result, as shown in FIG. 6, it has been determined that the output value of microwaves can be properly set in accordance with the quantity of the honeycomb bodies 1 in the drying bath 30.

Figure 6:
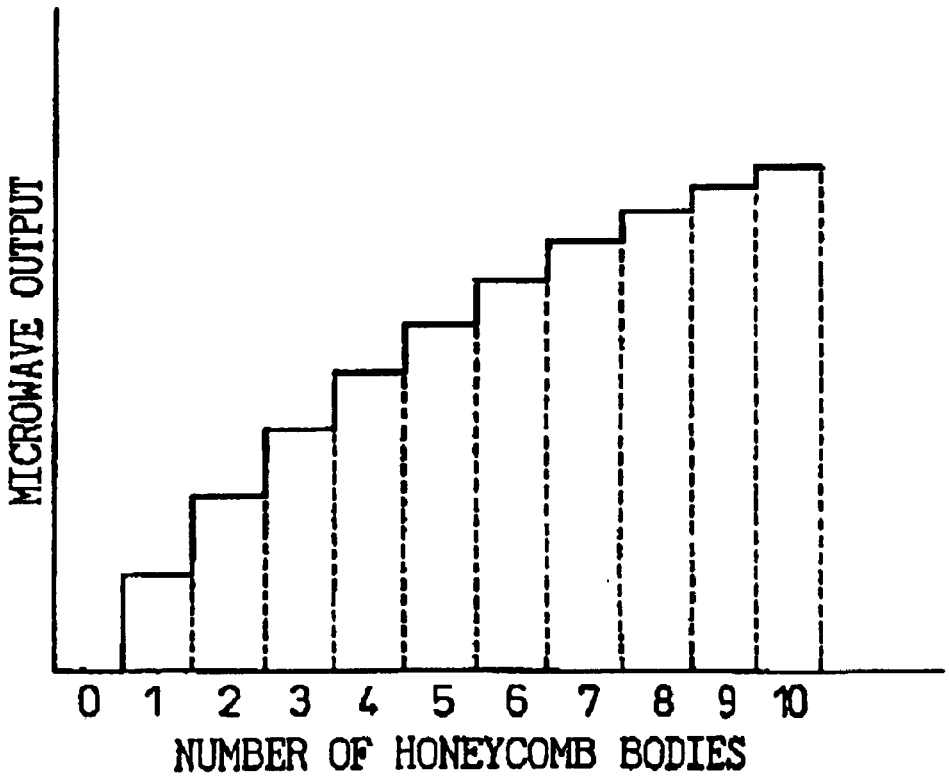
FIG. 6 is a graph showing the relation between the quantity of honeycomb bodies and the proper microwave output for the drying system according to a fifth embodiment of the invention.

In view of this, according to this embodiment, the honeycomb bodies 1 are dried while at the same time the microwave output is adjusted in accordance with the quantity of the honeycomb bodies 1 in the drying bath 30, as shown in FIG. 6.

According to this embodiment, even in the case where the quantity of the honeycomb bodies 1 in the drying bath 30 undergoes a change, microwaves can be uniformly radiated on each honeycomb body 1. As a result, the variations of the degree to which the honeycomb bodies 1 are dried can be effectively suppressed.

With the honeycomb bodies 1 having a thin cell wall, therefore, the generation of the cracking or wrinkling of the outer peripheral skin portion can be even more sufficiently prevented at the time of drying them.

The other parts of the configuration and the functions and effects of this embodiment are similar to those of the first embodiment.

Sixth Embodiment

This embodiment represents a case which employs the drying system with the microwave density variations in the drying bath 30 suppressed as in the first embodiment.

Figure 7:
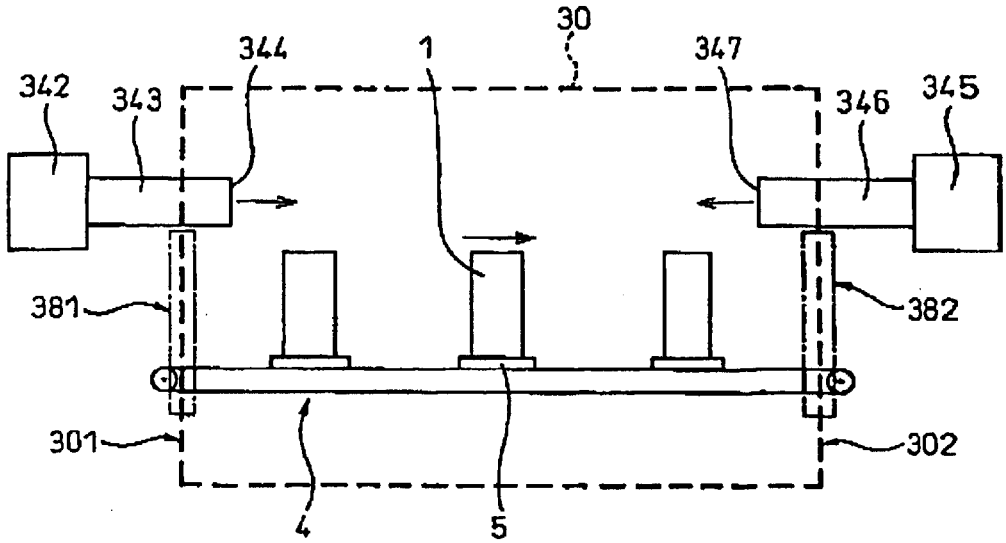
FIG. 7 is a side view for explaining the arrangement of the microwave introduction ports of the drying system according to a sixth embodiment of the invention.

As shown in FIG. 7, the drying system 3 according to this embodiment, based on the counterpart 3 of the first embodiment, is such that a microwave unit including the microwave generators, the waveguides and the microwave introduction ports is arranged differently from the first embodiment.

The drying system 3 according to this embodiment includes a first introduction port 344 arranged in the vicinity of the opening 381 for supplying the honeycomb bodies 1 to the drying bath 30 and a second introduction port 347 arranged in the vicinity of the opening 382 for delivering the honeycomb bodies out of the drying bath 30.

The first introduction port 344 is configured to radiate microwaves toward the opening 382 on delivery side and the second introduction port 347 to radiate microwaves toward the opening 381 on supply side.

According to this embodiment, the honeycomb bodies 1 are dried using the drying system 3 configured as described above.

In the drying bath 30, the variations in the microwave density are suppressed on both supply and delivery sides in the drying bath 30. The honeycomb bodies 1 are thus uniformly irradiated with microwaves while being conveyed within the drying bath 30.

According to this embodiment, therefore, the drying operation of the honeycomb bodies 1 proceeds at a predetermined rate, thereby preventing the troubles at the time of drying the honeycomb bodies.

The other parts of the configuration and the functions and effects of this embodiment are similar to those of the first embodiment.

Seventh Embodiment

This embodiment represents a case employing the drying system with the variations in the microwave density in the drying bath 30 suppressed as in the first embodiment.

Figure 8:
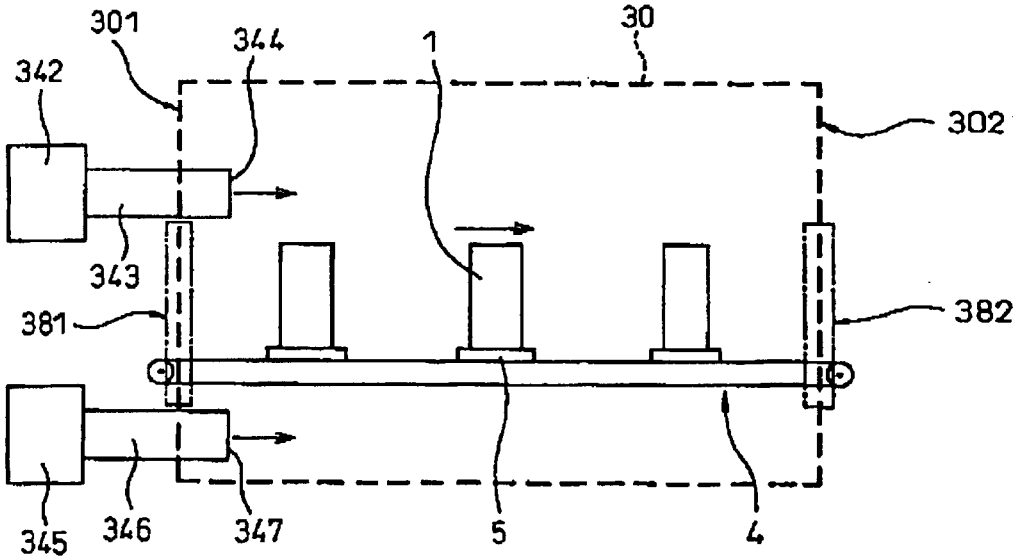
FIG. 8 is a side view for explaining the arrangement of the microwave introduction ports of the drying system according to a seventh embodiment of the invention.

As shown in FIG. 8, in the drying system 3 according to this embodiment based on the counterpart 3 in the first embodiment, the arrangement of a microwave unit including the microwave generators, the waveguides and the microwave introduction ports is changed.

The drying system 3 according to this embodiment includes a first introduction port 344 arranged above the opening 381 for supplying the honeycomb bodies 1 to the drying bath 30 and a second introduction port 347 arranged under the opening 381.

The first introduction port 344 and the second introduction port 347 are configured in such a manner as to radiate microwaves toward the opening 382 for delivering the honeycomb bodies 1 out of the drying bath 30.

According to this embodiment, the honeycomb bodies 1 are dried using the drying system 3 configured as described above.

In the drying bath 30, the density irregularities of the microwave radiated along the direction of conveyance are suppressed in the upper and lower portions of the drying bath. As a result, the upper and lower parts of the outer peripheral surface of each honeycomb body 1 can be equally irradiated with microwaves. According to this embodiment, therefore, the drying operation proceeds at the same rate at the upper and lower parts of the honeycomb body 1, thereby making it possible to prevent troubles which otherwise might occur at the time of drying.

The other parts of the configuration and the functions and effects of this embodiment are similar to those of the first embodiment.

Eighth Embodiment

This embodiment represents a case which employs a drying system with the microwave density irregularities in the drying bath 30 suppressed as in the first embodiment.

Figure 9:
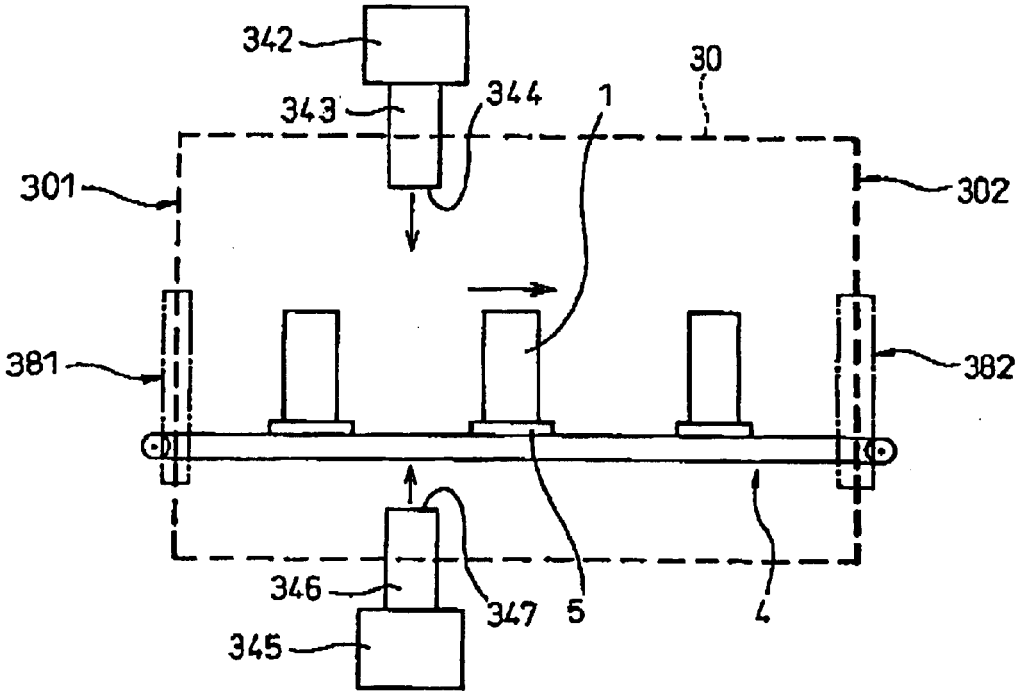
FIG. 9 is a side view for explaining the arrangement of the microwave introduction ports of the drying system according to an eighth embodiment of the invention.

As shown in FIG. 9, the drying system 3 according to this embodiment, based on the counterpart 3 of the first embodiment, has the arrangement changed of a microwave unit including the microwave generators, the waveguides and the microwave introduction ports.

The drying system 3 according to this embodiment includes a first introduction port 344 arranged at the top of the drying system 30 and a second introduction port 347 arranged at the lower part of the drying bath 30.

The first introduction port 344 is configured to radiate microwaves toward the lower part of the drying bath 30 and the second introduction port 347 to radiate microwaves toward the upper part of the drying bath 30.

According to this embodiment, the honeycomb bodies 1 are dried using the drying system 3 configured as described above.

In the drying bath 30, the density irregularities of microwaves radiated in vertical direction are suppressed in the upper and lower parts of the drying bath, As a result, the two end surfaces of each honeycomb body 1 can be equally irradiated with the microwave. According to this embodiment, therefore, the drying operation proceeds at the same rate at the upper and lower parts of each honeycomb body 1, thereby making it possible to prevent troubles which otherwise might occur at the time of drying.

The other parts of the configuration and the functions and effects of this embodiment are similar to those of the first embodiment.

Ninth Embodiment

This embodiment represents a case which employs a drying system with the microwave density irregularities in the drying bath 30 are suppressed as in the first embodiment.

Figure 10:
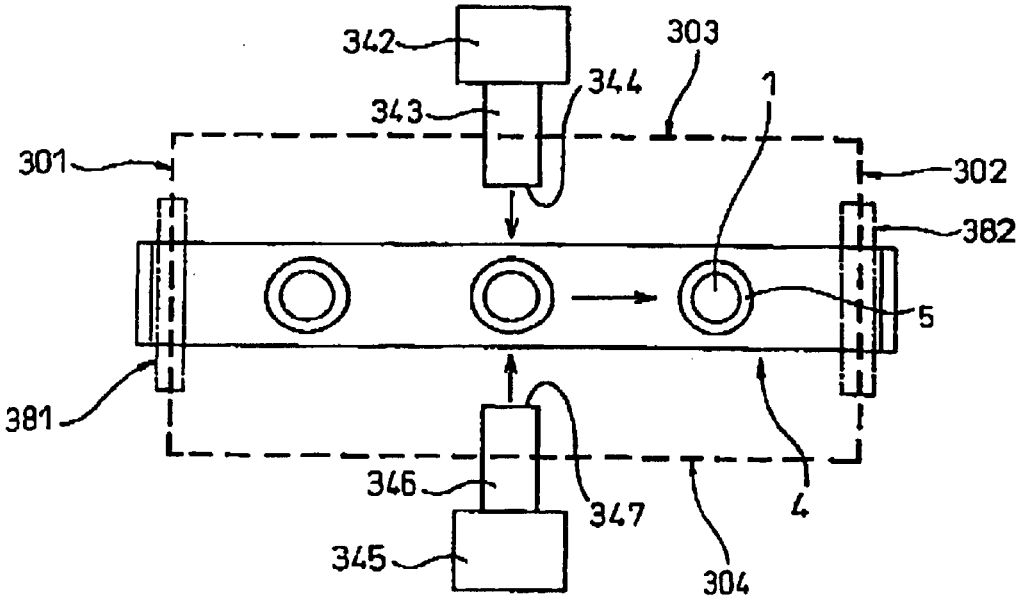
FIG. 10 is a top plan view for explaining the arrangement of the microwave introduction ports of the drying system according to a ninth embodiment of the invention.

As shown in FIG. 10, the drying system 3 according to this embodiment, based on the counterpart 3 of the first embodiment, has the arrangement changed of the microwave unit including the microwave generators, the waveguides and the microwave introduction ports.

The drying system 3 according to this embodiment includes a first introduction port 344 arranged on the side surface 303 of the drying system 30 and a second introduction port 347 arranged on the side surface 304 in opposed relation to the side surface 303. The first introduction port 344 is configured to radiate microwaves toward the side surface 304 and the second introduction port 347 to radiate microwaves toward the side surface 303 of the drying bath 30.

According to this embodiment, the honeycomb bodies 1 are dried using the drying system 3 configured as described above.

In the drying bath 30, the density irregularities of microwaves are suppressed on the two sides of the drying bath with the conveyor system therebetween. As a result, the two side surfaces of each honeycomb body 1 transverse to the direction of conveyance can be equally irradiated with microwaves. According to this embodiment, therefore, the drying operation proceeds in the same manner on the two sides of the honeycomb body A, thereby making it possible to prevent troubles which otherwise might occur at the time of drying.

The other parts of the configuration and the functions and effects of this embodiment are similar to those of the first embodiment.

As another alternative, the microwave introduction ports may be arranged in the drying bath as a combination of all or a part of the sixth to ninth embodiments. In such a case, a given combination of the arrangements of the microwave introduction ports in the drying bath can be selected in accordance with the volume, length and height of the drying bath or the quantity of the honeycomb bodies supplied at a time to the drying bath applicable to the drying system. In this way, the variations of the microwave density in the drying bath can be further suppressed for even more improved effects.

Tenth Embodiment

This embodiment represents a case which employs the drying system 6 of batch type.

Figure 11:
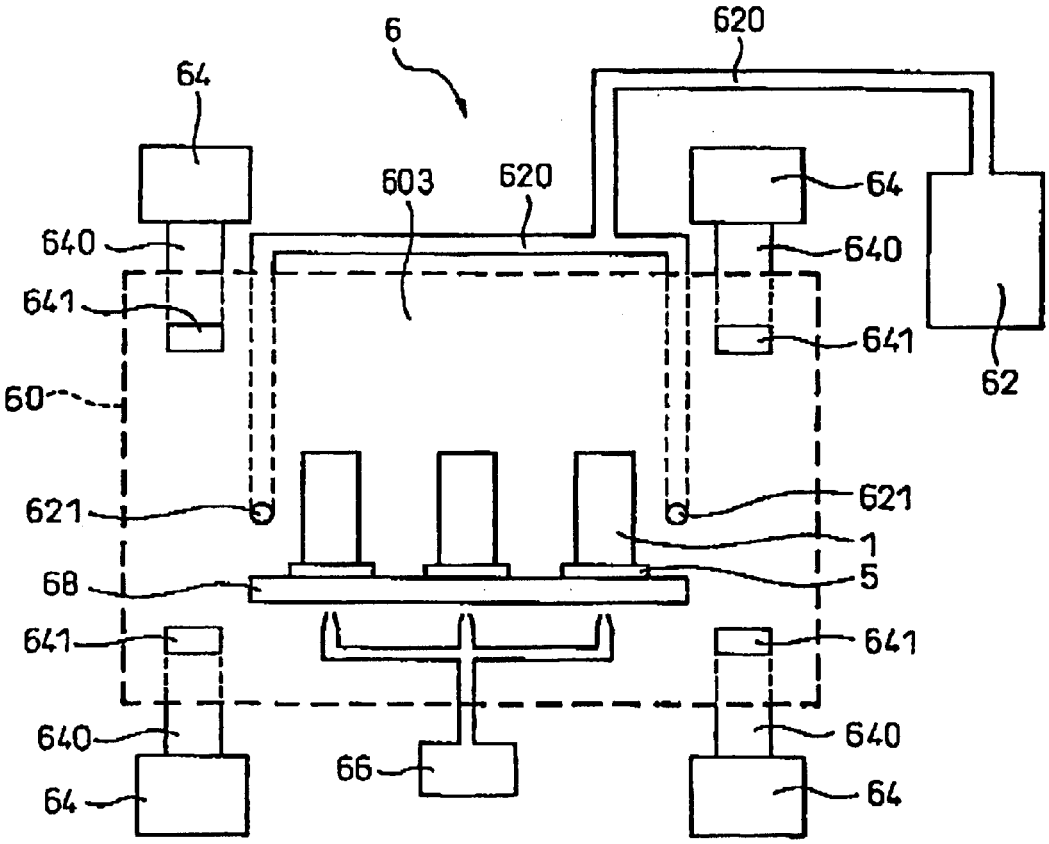
FIG. 11 is a diagram for explaining a configuration of the drying system according to a tenth embodiment of the invention.

The drying system 6 according to this embodiment, as shown in FIG. 11, comprises a drying bath 60 for accommodating the honeycomb bodies 1, a humidifier 62 for creating a high-humidity ambience of not less than 70% in humidity in the drying bath 60, and a plurality of microwave generators 64 for supplying the interior of the drying bath 60 with microwaves in the frequency range of 1,000 to 10,000 MHz.

A rest 68 capable of supporting a plurality of honeycomb bodies 1, each placed on the conveyance tray 5, is arranged in the drying bath 60. The rest 66 has air permeability as it is formed with a plurality of vertical through holes.

Also, waveguides 640 extending from the four microwave generators 64 are connected and opened at the four corner portions of one side wall 603 of the drying bath 60. These openings provide microwave introduction ports 641. Further, the drying bath 60 has an inlet, not shown, by way of which the honeycomb bodies 1 can be supplied and delivered.

Two steam pipes 620 extending and branching from a boiler constituting the humidifier 62 are connected and open at two lateral points of the side wall 603. These openings provide the steam introduction ports 621, The steam introduced from the steam introduction ports 621 is a high-temperature steam sent from the boiler as described above and has a temperature of not lower than According to this embodiment, a hot air generator 66 is arranged in the drying bath 60. This hot air generator 66 is configured to blow the hot air of 120° C. upward from under the rest 68. The hot air flows through the rest 68 and the conveyance trays 5 and passes through the cells 10 of the honeycomb bodies 1. The conveyance tray 5 is similar to the one used in the first embodiment.

In drying the honeycomb bodies 1 using the drying system 6, the first step is to place on the conveyance trays 5 a plurality of honeycomb bodies 1 of predetermined length into which the honeycomb body stock is cut, and arrange each pair of a mold and a tray on the rest 68, as shown in FIG. 11. Under this condition, the high-temperature steam is introduced from the humidifier 62 into the drying bath 60 thereby to form a high-humidity ambience of not lower than 70% in humidity, while at the same time introducing microwaves from the microwave generators 64 for performing the microwave heating process.

In this embodiment, the microwave heating process is carried out in the high-humidity ambience to such an extent that the water content of each honeycomb body 1 is reduced to between 10 and 20%. After that, the introduction of both the high-temperature steam and the microwave is stopped. After ventilating the interior of the drying bath 60, the hot air is blown up from the hot air generator 66. As a result, the hot air that has passed through the rest 68 and the conveyance trays 5 is passed through the cells 10 of each honeycomb body 1. Thus, the water content of the honeycomb body 1 is reduced to 5% or less so that the honeycomb body 1 is completely dried.

After that, all the honeycomb bodies 1 are delivered out of the drying bath 60, and then another batch of the honeycomb bodies 1 to be dried is arranged in the drying bath 60. In this way, the series of drying steps described above can be repeated.

As described above, according to this embodiment, a superior drying process can be implemented, like the continuous drying system 3 in the first embodiment, by using the drying system 6 of batch type.

The other functions and effects are similar to those of the first embodiment.

11th Embodiment

This embodiment represents a case in which the high-temperature honeycomb bodies 1 are cooled further by cool air after being dried with hot air as in the first embodiment.

Figure 12:
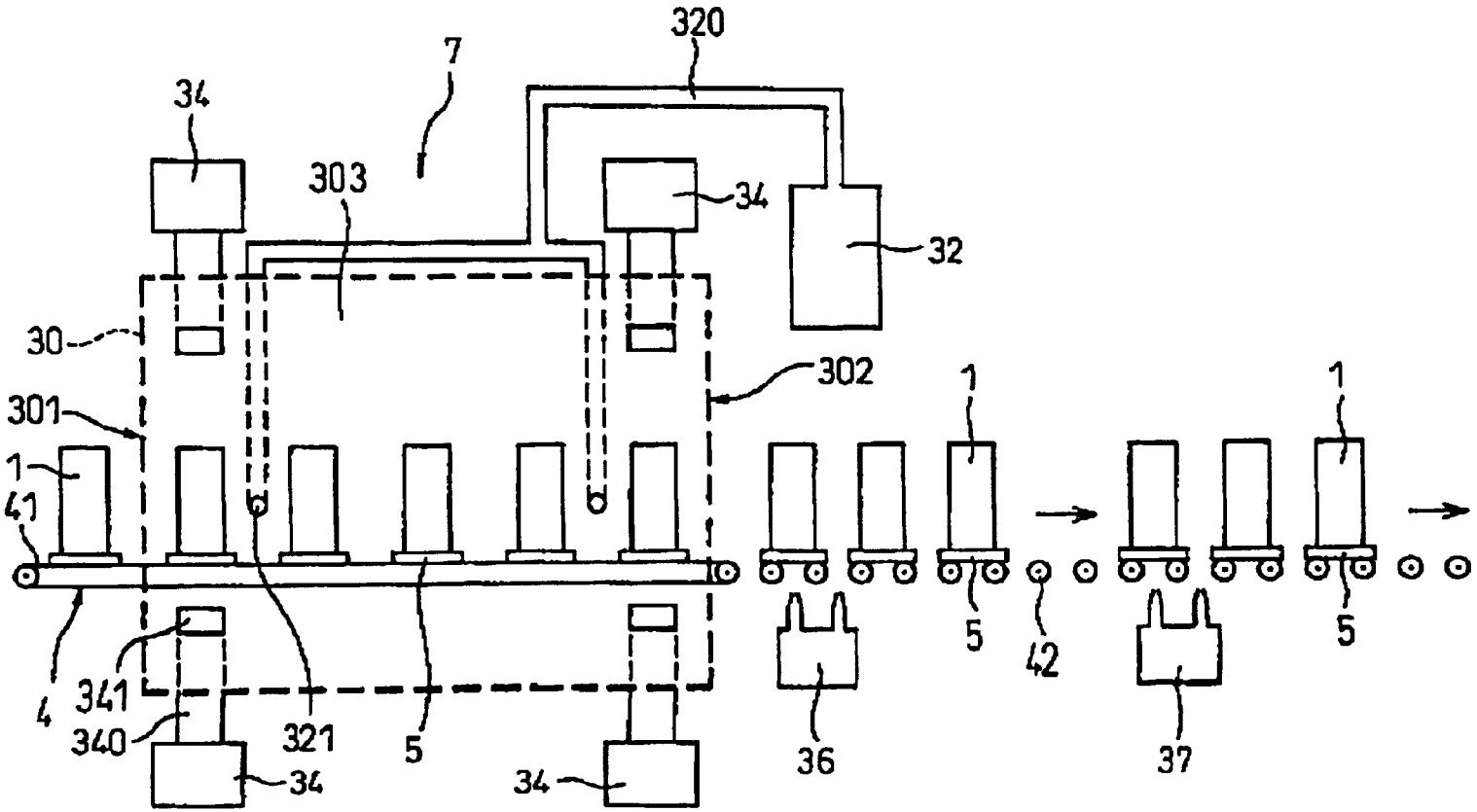
FIG. 12 is a diagram for explaining a configuration of the drying system according to an 11th embodiment of the invention.

As shown in FIG. 12, the drying process is executed using the drying system 7. The drying system 7 based on the drying system 3 of the first embodiment additionally includes a cool air generator 37. Specifically, the cool air generator 37 is arranged downstream of the conveyor system 4 adjacently to the hot air generator 36. The cool air generator 37 is so configured as to blow the cool air of 15° C. in vertical direction toward the conveyance trays 5 moving on the roller conveyor 42.

According to this embodiment, the drying process for the honeycomb bodies 1 is carried out using the drying system 7 configured as described above. A specific explanation will be made below.

As explained with reference to the first embodiment, the honeycomb bodies 1 supplied to the drying system 7 are irradiated with microwaves and dried to such an extent that the water content is reduced to a predetermined level. After that, the honeycomb bodies 1 are exposed to the hot air generated by the hot air generator 36 and completely dried as described above.

The high-temperature honeycomb bodies 1 are then conveyed over the roller conveyor 42 and reach the position above the cool air generator 37. According to this embodiment, the cool air generated from the cool air generator 37 is applied to the honeycomb bodies 1 already dried with hot air, in such a manner as to pass through the cells 10. Specifically, this embodiment is an example of the combination of the microwave heating means and the hot air further combined with the forced cooling means with cool air. More specifically, the honeycomb bodies 1 are cooled to 30° C. or lower.

As described above, the honeycomb bodies 1 delivered out of the drying system 7 are sufficiently cooled. Therefore, even in the case where the two end surfaces of each honeycomb body 1 are cut off immediately after being delivered out of the drying system 7, the cutting dust is not attached to the honeycomb bodies 1.

Thus, according to this embodiment, the time of transfer from the drying step to the next step can be shortened so that the honeycomb bodies 1 can be fabricated efficiently.

The other parts of the configuration and the functional effects remain same as those of the first embodiment.

What is claimed is:

1. A method of fabricating at least a honeycomb ceramic body that comprises a multiplicity of cells having the wall thereof not more than 0.125 mm thick, the method comprising:

placing at least one extrusion-molded argillaceous honeycomb body on a conveyance tray of porous ceramic having a dielectric loss of not more than 0.1, a porosity of not less than 10% and a sectional open area ratio of not less than 50% and drying by exposure to a high humidity ambience of not less than 70% in humidity and irradiation with microwaves in the frequency range of 1,000 to 10,000 MHz.

2. A method of fabricating at least a honeycomb body according to claim 1, wherein said honeycomb body is placed on a conveyance tray with one of the open ends of each cell of said mold kept in contact with the upper surface of said conveyance tray.

3. A method of fabricating at least a honeycomb at least a honeycomb ceramic body that comprises a multiplicity of cells having the wall thereof not more than 0.125 mm thick, the method comprising:

placing at least an extrusion-molded argillaceous honeycomb body on a conveyance tray made of foamed urea resin having a dielectric loss of not more than 0.1, a porosity of not less than 10% and a sectional open area ratio of not less than 50%, and drying by exposure to a high humidity ambience of not less than 70% in humidity and irradiation with microwaves in the frequency range of 1,000 to 10.000 MHz.

4. A method of fabricating at least a honeycomb body according to claim 1, wherein a plurality of honeycomb bodies are dried with adjacent ones thereof placed at predetermined spatial intervals.

5. A method of fabricating at least a honeycomb body according to claim 1, wherein a plurality of the honeycomb bodies are dried while changing the conditions for microwave radiation in accordance with the quantity of the honeycomb bodies.

6. A method of fabricating a honeycomb ceramic body that comprises a multiplicity of cells arranged in the shape of a honeycomb and having the wall thereof not more than 0.125 mm thick, the method comprising:

drying at least one extrusion-molded argillaceous honeycomb body by exposure to a high humidity ambience of not less than 70% in humidity and irradiation with microwaves in the frequency range of 1,000 to 10,000 MHz, and applying hot air to said honeycomb body in such a manner as to pass through the cells thereof after said drying.

7. A method of fabricating at least a honeycomb ceramic body according to claim 6, wherein the temperature of said hot air is 50 to 140° C.

8. A method of fabricating at least a honeycomb ceramic body according to claim 6, wherein said honeycomb body is dried by applying the hot air thereto after the water content of the honeycomb body is reduced to 5 to 30% by weight by radiation of the microwave.

9. A method of fabricating at least a honeycomb ceramic body according to claim 6, wherein said honeycomb body is dried by applying cool air after hot air is applied thereto.

10. A method of fabricating at least a honeycomb ceramic body according to claim 9, wherein the temperature of the cool air is 0 to 30° C.

* * * * *